US010267309B2

(12) United States Patent
Tsuzuki

(10) Patent No.: US 10,267,309 B2
(45) Date of Patent: Apr. 23, 2019

(54) GEAR PUMP AND GEAR MOTOR

(71) Applicant: DAIKIN INDUSTRIES, LTD., Osaka-shi, Osaka (JP)

(72) Inventor: Katsunari Tsuzuki, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 139 days.

(21) Appl. No.: 15/515,572

(22) PCT Filed: Sep. 29, 2015

(86) PCT No.: PCT/JP2015/077623
§ 371 (c)(1),
(2) Date: Mar. 29, 2017

(87) PCT Pub. No.: WO2016/052570
PCT Pub. Date: Apr. 7, 2016

(65) Prior Publication Data

US 2017/0298934 A1 Oct. 19, 2017

(30) Foreign Application Priority Data

Sep. 30, 2014 (JP) ..... 2014-201444

(51) Int. Cl.
*F01C 1/16* (2006.01)
*F01C 1/24* (2006.01)
(Continued)

(52) U.S. Cl.
CPC ..... *F04C 2/16* (2013.01); *F01C 21/02* (2013.01); *F01C 21/08* (2013.01); *F03C 2/08* (2013.01);
(Continued)

(58) Field of Classification Search
CPC .... F04C 2/16; F04C 2/18; F04C 15/00; F04C 15/06; F04C 2240/50; F04C 2240/30; F03C 2/08; F01C 21/08; F01C 21/02
(Continued)

(56) References Cited

U.S. PATENT DOCUMENTS 6,887,055 B2 5/2005 Morselli
2009/0311120 A1 12/2009 Okada
(Continued)

FOREIGN PATENT DOCUMENTS

JP 4829957 B2 9/2011
JP 5465366 B1 4/2014
WO 2013/186839 A1 12/2013

OTHER PUBLICATIONS

JPWO2013186839 (A1)—Mukai Nobuo—Gear Pump or Motor—Feb. 2016—English Translation.*
(Continued)

*Primary Examiner* — Theresa Trieu
(74) *Attorney, Agent, or Firm* — Global IP Counselors, LLP

(57) ABSTRACT

A gear pump or a gear motor includes a casing, a helical drive gear, a helical driven gear, a drive-side space, and an idler-side space. The drive and driven gears mesh with each other in the casing to partition inside of the casing so as to include high and low pressure spaces. The drive-side and idler-side spaces are each configured to allow pressure therein to become higher than a pressure in the low-pressure space. The drive-side space faces an end portion of a drive shaft rotatably supporting the drive gear. The idler-side space faces an end portion of an idler shaft rotatably supporting the driven gear. The end portion of the drive shaft is pushed in a predetermined direction by working fluid supplied to the drive-side space. The end portion of the idler
(Continued)

shaft is pushed in the predetermined direction by working fluid supplied to the idler-side space.

4 Claims, 8 Drawing Sheets

(51) Int. Cl.

| | |
|---|---|
| ***F03C 2/00*** | (2006.01) |
| ***F04C 2/16*** | (2006.01) |
| ***F04C 2/18*** | (2006.01) |
| ***F03C 2/08*** | (2006.01) |
| ***F04C 15/00*** | (2006.01) |
| ***F01C 21/02*** | (2006.01) |
| ***F01C 21/08*** | (2006.01) |
| ***F04C 15/06*** | (2006.01) |

(52) U.S. Cl.
CPC ..... *F04C 2/18* (2013.01); *F04C 15/00* (2013.01); *F04C 15/06* (2013.01); *F04C 2240/30* (2013.01); *F04C 2240/50* (2013.01)

(58) Field of Classification Search
USPC ..... 418/201.1–201.3, 131–132
See application file for complete search history.

(56) References Cited

U.S. PATENT DOCUMENTS

| | | | | |
|---|---|---|---|---|
| 2012/0114514 | A1 | 5/2012 | Laetzel et al. | |
| 2016/0169225 | A1* | 6/2016 | Takeda ..... | F04C 2/18 418/201.1 |

OTHER PUBLICATIONS

International Preliminary Report of corresponding PCT Application No. PCT/JP2015/077623 dated Apr. 13, 2017.
European Search Report of corresponding EP Application No. 15 84 6157.4 dated Feb. 23, 2018.
International Search Report of corresponding PCT Application No. PCT/JP2015/077623 dated Dec. 28, 2015.

* cited by examiner

CLOSED STATE

OPEN STATE

CLOSED STATE

OPEN STATE

CLOSED STATE

OPEN STATE

CLOSED STATE

OPEN STATE

GEAR PUMP AND GEAR MOTOR

CROSS-REFERENCE TO RELATED APPLICATIONS

This U.S. National stage application claims priority under 35 U.S.C. § 119(a) to Japanese Patent Application No. 2014-201444, filed in Japan on Sep. 30, 2014, the entire contents of which are hereby incorporated herein by reference.

TECHNICAL FIELD

The present invention relates to a gear pump or gear motor, which includes a drive gear and a driven gear each configured as a helical gear, for example.

BACKGROUND ART

There are known gear pumps each including a drive gear and a driven gear meshing with each other. In such a gear pump having meshing gears each configured as a helical gear, end portions of the gears are pressed onto a side plate by a thrust force produced by the meshing of teeth of the gears and a thrust force due to hydraulic pressure exerted on tooth surfaces of the gears. This may cause a disadvantage such as wearing out of the end portions of the drive gear and the driven gear, and reduction in mechanical efficiency due to friction.

SUMMARY

Technical Problem

To deal with the above-described problem, the gear pump described in U.S. Pat. No. 6,887,055 is structured as follows: the gear pump includes pistons contactable with an end portion of a drive shaft and an end portion of an idler shaft, respectively; and the drive shaft and the idler shaft are pushed by the respective pistons, to cancel out the thrust forces. Although the thrust forces are cancelled out with the above arrangement, the friction between the end portions of the shafts and the pistons leads to wearing out of the end portions. In addition, reduction in mechanical efficiency due to the friction cannot be sufficiently prevented.

In view of the above, an object of the present invention is to provide a gear pump or a gear motor capable of preventing reduction in mechanical efficiency.

Solution to Problem

According to a first aspect of the invention, a gear pump or a gear motor includes; a casing; a drive gear and a driven gear each configured as a helical gear, the drive gear and the driven gear meshing with each other in the casing and partitioning an inside of the casing so as to include a high-pressure space and a low-pressure space; and a drive-side space and an idler-side space each configured to allow pressure therein to become higher than a pressure in the low-pressure space, the drive-side space facing an end portion of a drive shaft rotatably supporting the drive gear, the idler-side space facing an end portion of an idler shaft rotatably supporting the driven gear. The end portion of the drive shaft is pushed in a predetermined direction by working fluid in the drive-side space, and the end portion of the idler shaft is pushed in the predetermined direction by working fluid in the idler-side space.

In this gear pump or gear motor, the drive-side space facing the end portion of the drive shaft and the idler-side space facing the end portion of the idler shaft are provided. The drive shaft and the idler shaft are respectively pushed by the pressure of the working fluid in the drive-side space and the pressure of the working fluid in the idler-side space, and therefore the thrust forces are cancelled out. Thus, as compared with the arrangement in which friction between the end portions of the gears and the side plate is prevented by the pistons contactable with the end portions of the shafts, reduction in mechanical efficiency and wearing out of parts are prevented.

According to a second aspect of the invention, the gear pump or gear motor of the first aspect further includes: a drive-side opening closing member configured so that when the pressure in the drive-side space is not higher than a drive-side intermediate pressure, which is lower than a pressure in the high-pressure space, fluid communication between the drive-side space and the low-pressure space is not allowed, and when the pressure in the drive-side space exceeds the drive-side intermediate pressure, fluid communication between the drive-side space and the low-pressure space is allowed; and an idler-side opening closing member configured so that when the pressure in the idler-side space is not higher than an idler-side intermediate pressure, which is lower than the pressure in the high-pressure space, fluid communication between the idler-side space and the low-pressure space is not allowed, and when the pressure in the idler-side space exceeds the idler-side intermediate pressure, fluid communication between the idler-side space and the low-pressure space is allowed.

In this gear pump or gear motor, the pressure in the drive-side space into which high pressure working fluid flows is adjusted so as to be not higher than the drive-side intermediate pressure lower than the pressure in the high-pressure space, and the pressure in the idler-side space into which high pressure working fluid flows is adjusted so as to be not higher than the idler-side intermediate pressure lower than the pressure in the high-pressure space. This prevents application of too large pushing forces to the drive shaft and the idler shaft, respectively based on the pressure of the working fluid in the drive-side space and the pressure of the working fluid in the idler-side space.

According to a third aspect of the invention, the gear pump or gear motor of the second aspect is arranged such that each of the drive-side opening closing member and the idler-side opening closing member includes: a closing operation pressure receiving surface facing the high-pressure space intro which working fluid at a high pressure is introduced; an opening operation pressure receiving surface facing the drive-side space or the idler-side space and being larger than the closing operation pressure receiving surface.

In this gear pump or gear motor, by changing the difference in area between the closing operation pressure receiving surface and the opening operation pressure receiving surface of each opening closing member, the ratio of the drive-side intermediate pressure to the high pressure and the ratio of the idler-side intermediate pressure to the high pressure are changeable, and thus, the levels of the drive-side intermediate pressure and the idler-side intermediate pressure are adjustable.

According to a fourth aspect of the invention, the gear pump or gear motor of any one of the first to third aspects further includes a drive-side beating member provided around an outer circumference of the drive shaft, and an idler-side bearing member provided around an outer circumference of the idler shaft, and the drive-side opening closing member is provided in the drive-side bearing member, and the idler-side opening closing member is provided in the idler-side bearing member.

In this gear pump or gear motor, the total length of the gear pump or gear motor is shortened as compared with a gear pump or gear motor in which the opening closing members are respectively disposed to be opposed to the drive shaft and the idler shaft, for example.

Advantageous Effects of Invention

As described above, the present invention provides the following advantageous effects.

In the first aspect, the drive-side space facing the end portion of the drive shaft and the idler-side space facing the end portion of the idler shaft are provided. The drive shaft and the idler shaft are respectively pushed by the pressure of the working fluid in the drive-side space and the pressure of the working fluid in the idler-side space, and therefore the thrust forces are cancelled out. Thus, as compared with the arrangement in which friction between the end portions of the gears and the side plate is prevented by the pistons contactable with the end portions of the shafts, reduction in mechanical efficiency and wearing out of parts are prevented.

In the second aspect, the pressure in the drive-side space into which high pressure working fluid flows is adjusted so as to be not higher than the drive-side intermediate pressure lower than the pressure in the high-pressure space, and the pressure in the idler-side space into which high pressure working fluid flows is adjusted so as to be not higher than the idler-side intermediate pressure lower than the pressure in the high-pressure space. This prevents application of too large pushing forces to the drive shaft and the idler shaft, respectively based on the pressure of the working fluid in the drive-side space and the pressure of the working fluid in the idler-side space.

In the third aspect, by changing the difference in area between the closing operation pressure receiving surface and the opening operation pressure receiving surface of each opening closing member, the ratio of the drive-side intermediate pressure to the high pressure and the ratio of the idler-side intermediate pressure to the high pressure are changeable, and thus, the levels of the drive-side intermediate pressure and the idler-side intermediate pressure are adjustable.

In the fourth aspect, the total length of the gear pump or gear motor is shortened as compared with a gear pump or gear motor in which the opening closing members are respectively disposed to be opposed to the drive shaft and the idler shaft, for example.

DESCRIPTION OF EMBODIMENTS

The following describes embodiments of a gear pump related to the present invention, with reference to the drawings.

(First Embodiment)

[Overall Structure of Gear Pump]

Figure 1:
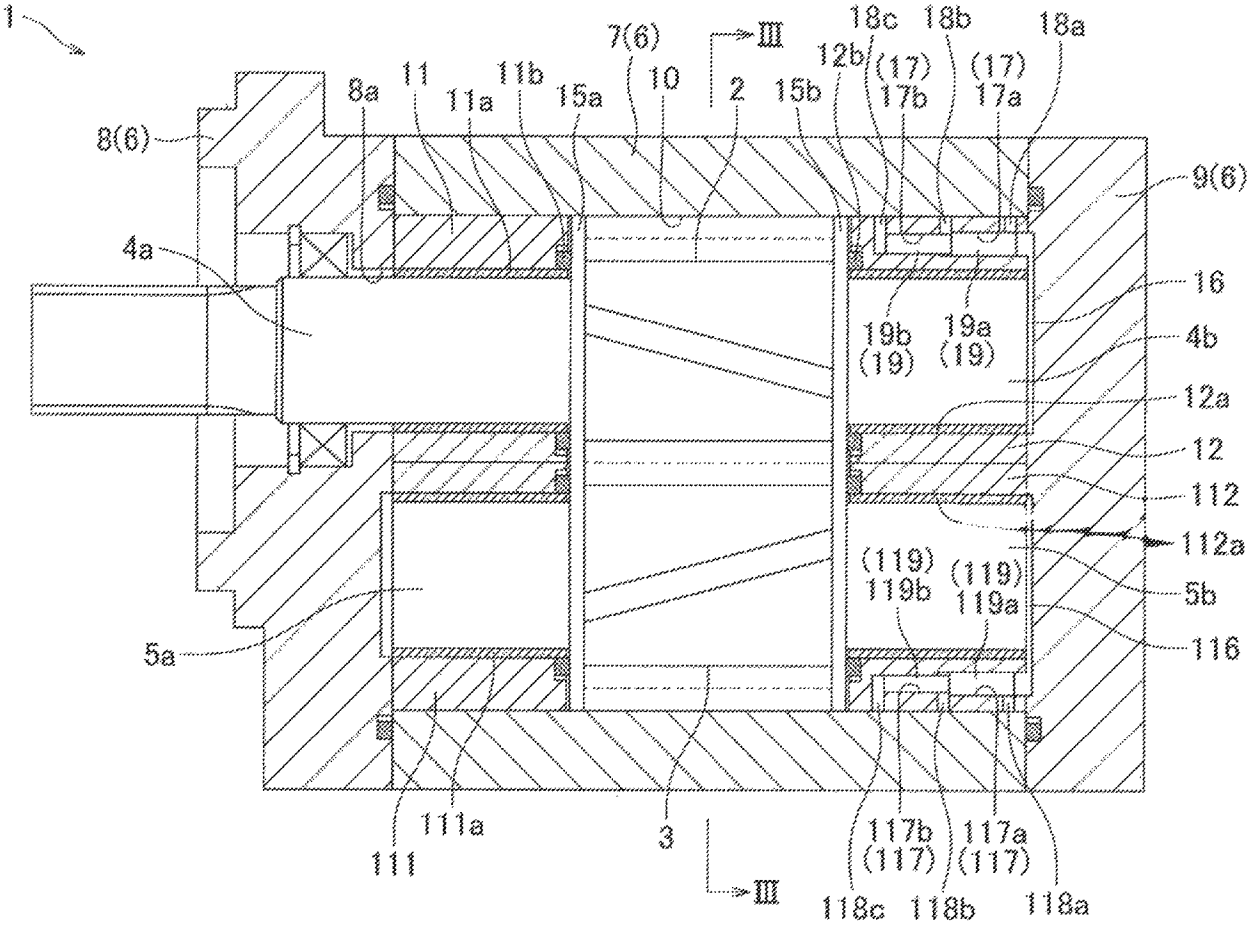
FIG. 1 is an explanatory diagram illustrating e overall structure of a gear pump of First Embodiment of the present invention.

As shown in FIG. 1, a gear pump 1 of First Embodiment includes: a drive gear 2 and a driven gear (idler gear) 3 meshing with each other; drive shafts 4*a* and 4*b* rotatably supporting the drive gear 2 and idler shafts 5*a* and 5*b* rotatably supporting the driven gear 3; and a casing 6 accommodating therein the drive gear 2, the driven gear 3, the drive shafts 4*a* and 4*b*, and the idler shafts 5*a* and 5*b*. The gear pump 1 of the present embodiment is configured to suck working fluid such as hydraulic oil supplied from a tank storing the working fluid, to pressurize the fluid, and then to discharge the working fluid to a hydraulic apparatus.

The casing 6 includes: a main body 7 including an internal space (figure-eight cavity 10) having a cross section of an approximately figure-eight shape; a mounting 8 screwed with one end face of the main body 7; and a cover 9 screwed with the other end face of the main body 7 in the gear pump 1, the figure-eight cavity 10 inside the main body 7 is closed by the mounting 8 and the cover 9.

Figure 2:
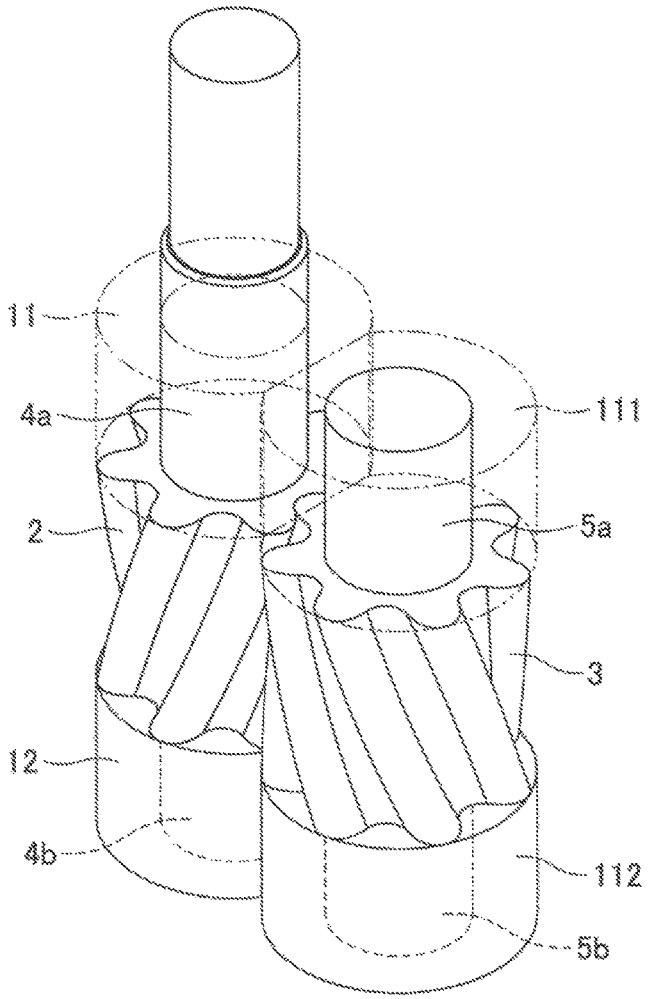
FIG. 2 is an explanatory diagram illustrating the structures of a drive gear and a driven gear.

As shown in FIG. 1 and FIG. 2, each of the drive gear 2 and the driven gear 3 is configured as a helical gear. The gears 2 and 3 are disposed in the figure-eight cavity 10 in the casing 6. In the figure-eight cavity 10, the drive shafts 4*a* and 4*b* respectively extend from opposite end surfaces of the drive gear 2 in the axial direction of the drive gear 2. The idler shafts 5*a* and 5*b* respectively extend from opposite end surfaces of the driven gear 3 in the axial direction of the driven gear 3. The drive shaft 4*a* is inserted into an insertion hole 8*a* of the mounting 8. A not-illustrated driving means is connected to an end portion of the drive shaft 4*a*. The drive gear 2 and the driven gear 3 meshing with each other are accommodated in the figure-eight cavity 10 in the gear pump 1. The drive gear 2 and the driven gear 3 are arranged so that their tooth tops slide on the inner surface of the figure-eight cavity 10.

A bearing case 11 and a bearing case 111 are inserted into the figure-eight cavity 10 in the casing 6. The bearing case 11 supports the drive shaft 4*a* extending leftward from the drive gear 2 in FIG. 1. The bearing case 111 supports the idler shaft 5*a* extending leftward from the driven gear 3 in FIG. 1. Each of the bearing cases 11 and 111 has a support hole. A bearing 11*a* for the drive shaft 4*a* is provided in the support hole of the bearing case 11. A bearing 111*a* for the idler shaft 5*a* is provided in the support hole of the bearing case 111. Thus, the bearing case 11 supports the drive shaft 4*a* in a rotatable manner as the drive shaft 4*a* is inserted into the bearing 11*a*, and the bearing case 111 supports the idler shaft 5*a* in a rotatable manner as the idler shaft 5*a* is inserted into the bearing 111*a*.

Similarly to the above, a bearing case 12 and a bearing case 112 are inserted into the figure-eight cavity 10 in the casing 6. The bearing case 12 supports the drive shaft 4*b* extending rightward from the drive gear 2 in FIG, 1. The bearing case 112 supports the idler shaft 5*b* extending rightward from the driven gear 3 in FIG. 1. Each of the bearing cases 12 and 112 has a support hole. A bearing 12*a* for the drive shaft 4*b* is provided in the support hole of the bearing case 12. A bearing 112*a* for the idler shaft 5*b* is provided in the support hole of the bearing case 112. Thus, the bearing case 12 supports the drive shaft 4*b* in a rotatable manner as the drive shaft 4*b* is inserted into the bearing 12*a*, and the bearing case 112 supports the idler shaft 5*b* in a rotatable manner as the idler shaft 5*b* is inserted into the bearing 112*a*.

Two side plates 15*a* and 15*b* are provided on opposite sides of the set of the drive gear 2 and the driven gear 3. The side plate 15*a* is a plate-like member having two through holes. The side plate 15*a* is in contact with end faces of the drive gear 2 and the driven gear 3, with the drive shaft 4*a* and the idler shaft 5*a* respectively inserted into the two through holes. Similarly to the above, the side plate 15*b* is a plate-like member having two through holes. The side plate 15*b* is in contact with end faces of the drive gear 2 and the driven gear 3, with the drive shaft 4*b* and the idler shaft 5*b* respectively inserted into the two through holes. As a consequence, the side plate 15*a* is interposed between the gears 2 and 3 and the bearing cases 11 and 111, and the side plate 15*b* is interposed between the gears 2 and 3 and the bearing cases 12 and 112.

Elastic sealing members 11*b* are respectively provided on the end faces of the bearing cases 11 and 111 that face the side plate 15*a*. Each sealing member 11*b* partitions a gap between the bearing case 11, 111 and the side plate 15*a* into a high-pressure-side part and a low-pressure-side part. The other end face of bearing case 11, 111, which is opposite from the above-described end face, is in contact with an end face of the mounting 8. This restricts movement of the bearing case 11, 111 in its axial direction. Similarly to the above, elastic sealing members 12*b* are respectively provided on the end faces of the bearing cases 12 and 112 that face the side plate 15*b*. Each sealing member 12*b* partitions a gap between the bearing case 12, 112 and the side plate 15*b* into a high-pressure-side part and a low-pressure-side part. The other end face of bearing case, which is opposite from the above-described end face, is in contact with an end face of the cover 9. This restricts movement of the bearing case 12, 112 in its axial direction.

Figure 3:
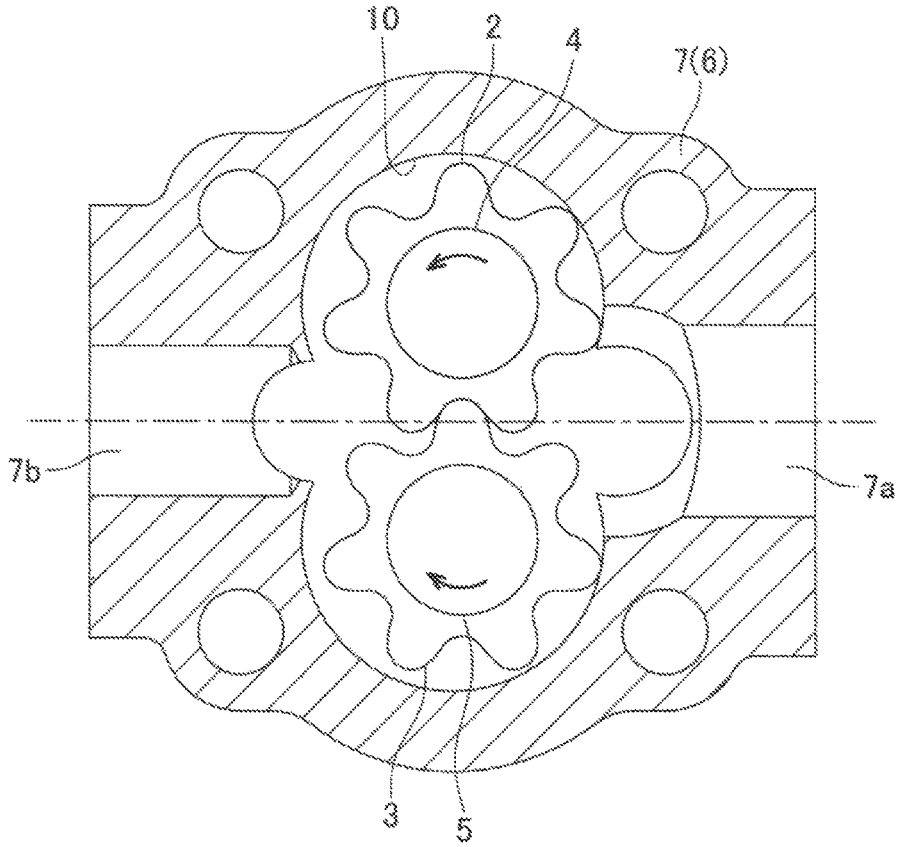
FIG. 3 is a cross section taken along a line III-III in FIG. 1.

As shown in FIG. 3, the main body 7 of the gear pump 1 has an intake hole 7*a* and a discharge hole 7*b* which a respectively provided through opposed side faces of the main body 7. The intake hole 7*a* communicates with a low-pressure space of the figure-eight cavity 10, and the discharge hole 7*b* communicates with a high-pressure space of the figure-eight cavity 10. Each of the intake hole 7*a* and the discharge hole 7*b* is disposed so that its axis passes through the center between the rotation axes of the drive gear 2 and the driven gear 3.

A pipe extending from the tank storing the working fluid is coupled to the intake hole 7*a* of the casing 6 of the gear pump 1. Meanwhile, a pipe extending toward the hydraulic apparatus is coupled to the discharge hole 7*b* of the casing 6. Further, the drive shaft 4*a* for the drive gear 2 is rotated by the not-illustrated driving means. As a result, the driven gear 3 meshing with the drive gear 2 rotates. As the gears 2 and 3 rotate, the working fluid in pockets between the tooth surfaces of the gears 2 and 3 and the inner surface of the figure-eight cavity 10 is carried toward the discharge hole 7*b*. Thus, the discharge side close to the discharge hole 7*b* with respect to the meshing of the gears 2 and 3 is the high pressure side, while the intake side close to the intake hole 7*a* with respect to the meshing of the gears 2 and 3 is the low pressure side.

The transfer of the working fluid to the discharge side (close to the discharge hole 7*b*) creates a vacuum on the intake side (close to the intake hole 7*a*), which pulls working fluid from the tank into the low-pressure space of the figure-eight cavity 10 through the pipe and the intake hole 7*a*. As the drive gear 2 and the driven gear 3 rotate, the working fluid in the pockets between the tooth surfaces of the gears 2 and 3 and the inner surface of the figure-eight cavity 10 is carried to the discharge side (close to the discharge hole 7*b*), pressurized under a high pressure, and then displaced to the hydraulic apparatus through the discharge hole 7*b* and the pipe.

As shown in FIG. 1, in the casing 6 of the gear pump 1 of the present embodiment, a drive-side space 16 and an idler-side space 116 are provided. The drive-side space 16 faces an end portion (right end portion in FIG. 1) of the drive shaft 4*b*. The idler-side space 116 faces an end portion (right end portion in FIG. 1) of the idler shaft 5*b*. The drive-side space 16 and the idler-side space 116 are respectively in recesses on the end face of the cover 9. Working fluid at discharge pressure (high pressure) flows into the drive-side space 16 and the idler-side space 116 from the figure-eight cavity 10. Each of the spaces 16 and 116 is configured so that pressure therein can be kept so as not to exceed a corresponding predetermined intermediate pressure, which is higher than a low pressure (pressure in the low-pressure space) and lower than the discharge pressure. Due to this, during the rotation of the drive gear 2 and the driven gear 3, the end portion of the drive shaft 4*b* is pushed leftward, in FIG. 1, by the working fluid supplied to the drive-side space 16, and the end portion of the idler shaft 5*b* is pushed leftward, in FIG. 1, by the working fluid supplied to the idler-side space 116. During the rotation of the drive gear 2 and the driven gear 3, a thrust force produced by the meshing of the teeth, a thrust force due to liquid pressure exerted on the tooth surfaces, and a thrust force due to liquid pressure exerted on side faces of the teeth are applied to the drive gear 2 and the driven gear 3, and therefore the gears 2 and 3 are pushed rightward. However, these thrust forces are cancelled out by the pushing force of the working fluid in the drive-side space 16 and the pushing force of the working fluid in the idler-side space 116.

Figure 4A:
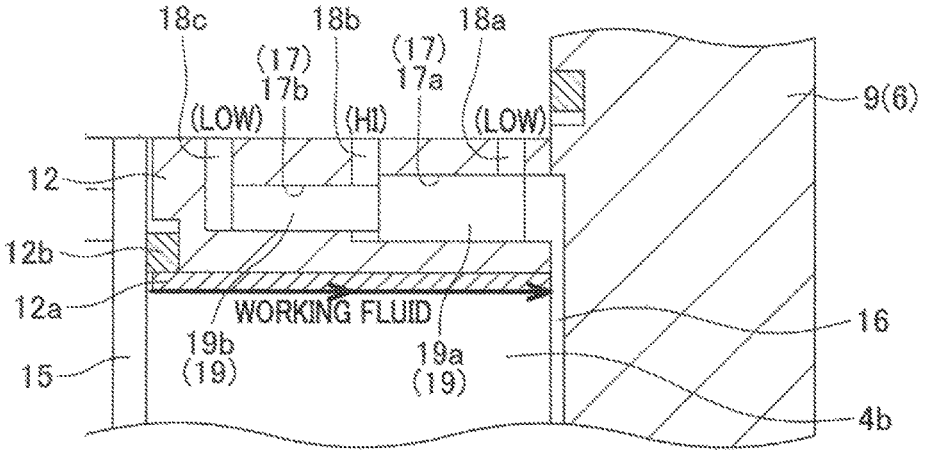
FIG. 4A and FIG, 4B each is an explanatory diagram illustrating an arrangement for pushing an end portion of a drive shaft leftward by working fluid supplied to a drive-side space.
Figure 4B:
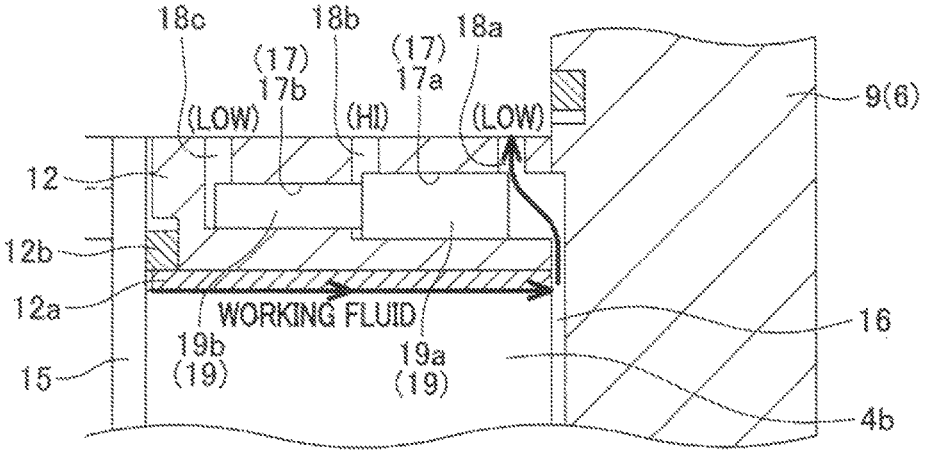

First of all, a description will be given for the arrangement for pushing the end portion of the drive shaft 4*b* leftward by the working fluid supplied to the drive-side space 16, with reference to FIG. 1 and FIGS. 4A and 4B. FIGS. 4A and 4B each is a schematic explanatory diagram illustrating movement of a piston 19. In these figures, the difference between the cross sectional area of a large diameter portion 19*a* and the cross sectional area of a small diameter portion 19*b*, for example, is exaggerated.

The bearing case 12 has a cylindrical hole 17 on an outer circumference side of the drive shaft 4*b*. The cylindrical hole 17 extends along the axial direction of the drive shaft 4*b*. In FIG. 1, the cylindrical hole 17 has an opening facing the end face of the cover 9, and extends leftward from the opening. The opening of the cylindrical hole 17 communicates with the drive-side space 16. The cylindrical hole 17 has: a large diameter hole 17*a* lose to the opening of the cylindrical hole 17; and a small diameter hole 17*b* disposed closer to the bottom of the cylindrical hole 17 than the large diameter hole 17*a*. The inner diameter of the small diameter hole 17*b* is slightly smaller than the inner diameter of the large diameter hole 17*a*.

The bearing case 12 has three (first to third) communication passages 18*a*, 18*b*, and 18*c* provided orthogonally to the cylindrical hole 17. The first communication passage 18*a* is provided near the opening of the cylindrical hole 17 so as to be communicable with the large diameter hole 17*a*. The second communication passage 18*b* communicates with the large diameter hole 17*a*. The third communication passage 18*c* is the closest to the bottom of the cylindrical hole 17 and communicates with the small diameter hole 17*b*.

The piston 19 is disposed inside the cylindrical hole 17 of the bearing case 12. The piston 19 has the large diameter portion 19*a* and the small diameter portion 19*b* unitary with the large diameter portion 19*a*. The piston 19 is inserted into the cylindrical hole 17 of the bearing case 12 in such a manner that: the large diameter portion 19*a* of the piston 19 is disposed in the large diameter hole 17*a* of the cylindrical hole 17; and the small diameter portion 19*b* of the piston 19 is disposed in the small diameter hole 17*b* of the cylindrical hole 17. The large diameter portion 19*a* has an outer diameter substantially equal to the inner diameter of the large diameter hole 17*a* of the cylindrical hole 17. The small diameter portion 19*b* has an outer diameter substantially equal to the inner diameter of the small diameter hole 17*b* of the cylindrical hole 17.

The first communication passage 18*a* and the third communication passage 18*c* of the bearing case 12 communicate with the low-pressure space of the figure-eight cavity 10 through unillustrated passages. The second communication passage 18*b* communicates with the high-pressure space of the figure-eight cavity 10 through an unillustrated passage.

A right end face of the large diameter portion 19*a* of the piston 19 is pushed leftward by the intermediate pressure working fluid supplied to the drive-side space 16. A left end face of the large diameter portion 19*a* (a portion of the left surface of the large diameter portion 19*a* that is not covered by the small diameter portion 19*b*) is pushed rightward by the discharge pressure working fluid supplied to the second communication passage 18*b*. The third communication passage 18*c* communicates with the low-pressure space of the figure-eight cavity 10. A left end face of the small diameter portion 19*b* is pushed by the working fluid in the third communication passage 18*c*. However, the force applied to the left end face of the small diameter portion 19*b* is negligibly small as compared with the force applied to the right end face of the large diameter portion 19*a* and the force applied to the left end face of the large diameter portion 19*a*, Consequently, the large diameter portion 19*a* of the piston 19 moves in the cylindrical hole 17, depending on which is larger, the force applied to the right end face of the large diameter portion 19*a* or the force applied to the left end face of the large diameter portion 19*a*. The magnitude of the force applied to the right end face of the large diameter portion 19*a* of the piston 19 is calculated by multiplying the pressure (P1) of the intermediate pressure working fluid supplied to the drive-side space 16 by the area (S1) of the right end face of the large diameter portion 19*a*. The magnitude of the force applied to the left end face of the large diameter portion 19*a* of the piston 19 is calculated by multiplying the pressure (P2) of the discharge pressure working fluid supplied to the second communication passage 18*b* (the pressure P2=discharge pressure) by the area (S2) of the left end face of the large diameter portion 19*a*. The area (S2) of the left end face of the large diameter portion 19*a* is calculated by subtracting the cross sectional area of the small diameter portion 19*b* from the cross sectional area of the large diameter portion 19*a*.

FIG. 4A shows a state in which fluid communication between the drive-side space 16 and the first communication passage 18*a* is not allowed. Hereinafter, this state is referred to as a closed state because the drive-side space 16 is closed. In this state, the large diameter portion 19*a* of the piston 19 faces the entire area of the opening of the first communication passage 18*a* opening to the cylindrical hole 17, and therefore the first communication passage 18*a* is closed by the large diameter portion 19*a*. When the drive gear 2 and the driven gear 3 are rotated, the working fluid in the high-pressure space of the figure-eight cavity 10 passes through a gap between the drive shaft 4*b* and the bearing 12*a* into the drive-side space 16. This increases the pressure (P1) of the working fluid in the drive-side space 16 toward the pressure level equal to that in the high-pressure space of the figure-eight cavity 10. As a result, the force applied to the right end face of the large diameter portion 19*a* of the piston 19 increases. Meanwhile, the magnitude of the force applied to the left end face of the large diameter portion 19*a* of the piston 19 is a product of the pressure (P2) of the discharge pressure working fluid in the second communication passage 18*b* and the area (S2) of the left end face of the large diameter portion 19*a*. That is, the force applied to the left end face of the large diameter portion 19*a* is always constant. Accordingly, until a sufficiently long period of time elapses from the entry into the closed state, i.e., when the pressure (P1) of the working fluid in the drive-side space 16 is not higher than a predetermined pressure value (predetermined drive-side intermediate pressure), the closed state in which fluid communication between the drive-side space 16 and the first communication passage 18*a* is not allowed is maintained because the force applied to the right end face of the large diameter portion 19*a* of the piston 19 is smaller than the force applied to the left end face of the large diameter portion 19*a* of the piston 19.

FIG. 4B shows a state in which fluid communication between the drive-side space 16 and the first communication passage 18*a* is allowed. Hereinafter, this state is referred to as an open state because the drive-side space 16 is not closed. In this state, the large diameter portion 19*a* of the piston 19 has been moved leftward, i.e., toward the bottom of the cylindrical hole 17, and therefore does not face the entire area of the opening of the first communication passage 18*a* opening to the cylindrical hole 17. Accordingly, the first communication passage 18*a* is not closed by the large diameter portion 19*a*. Transition to the open state, in which fluid communication between the drive-side space 16 and the first communication passage 18*a* is allowed, occurs in the following manner. During the rotation of the drive gear 2 and the driven gear 3, the working fluid in the high-pressure space of the figure-eight cavity 10 passes through the gap between the drive shaft 4*b* and the bearing 12*a* into the drive-side space 16. Then, the pressure (P1) of the working fluid in the drive-side space 16 increases, with the result that the force applied to the right end face of the large diameter portion 19*a* of the piston 19 becomes larger than the force applied to the left end face of the large diameter portion 19*a* of the piston 19. As a consequence, the large diameter portion 19*a* of the piston 19 moves leftward, and thus the transition to the open state occurs. Thereafter, the working fluid in the drive-side space 16 flows toward the low-pressure space of the figure-eight cavity 10 through the first communication passage 18*a*, and this decreases the pressure (P1) of the working fluid in the drive-side space 16 to a level substantially equal to the low pressure. As a result, the force applied to the right end face of the large diameter portion 19*a* of the piston 19 becomes smaller than the force applied to the left end face of the large diameter portion 19*a* of the piston 19, and this causes the large diameter portion 19*a* of the piston 19 to move rightward. Thus, transition to the closed state shown in FIG. 4A occurs.

As described above, the piston 19 functions as a drive-side opening closing member configured so that: when the pressure in the drive-side space 16 is not higher than the predetermined drive-side intermediate pressure, which is lower than the discharge pressure, fluid communication between the drive-side space 16 and the first communication passage 18*a* (low-pressure space), through which the working fluid is returned to the intake pressure side (low pressure side), is not allowed; and when the pressure in the drive-side space 16 exceeds the predetermined drive-side intermediate pressure, fluid communication between the drive-side space 16 and the first communication passage 18*a* (low-pressure space) is allowed. The piston 19 includes: the left end face (closing operation pressure receiving surface) of the large diameter portion 19*a* facing the second communication passage 18*b* (high-pressure space) which the discharge pressure working fluid is introduced; and a right end face (opening operation pressure receiving surface) of the large diameter portion 19*a* facing the drive-side space 16 and being larger than the closing operation pressure receiving surface. The piston 19 is disposed in the cylindrical hole 17 of the beating case 12 disposed around the outer circumference of the drive shaft 4*b*.

Figure 5A:
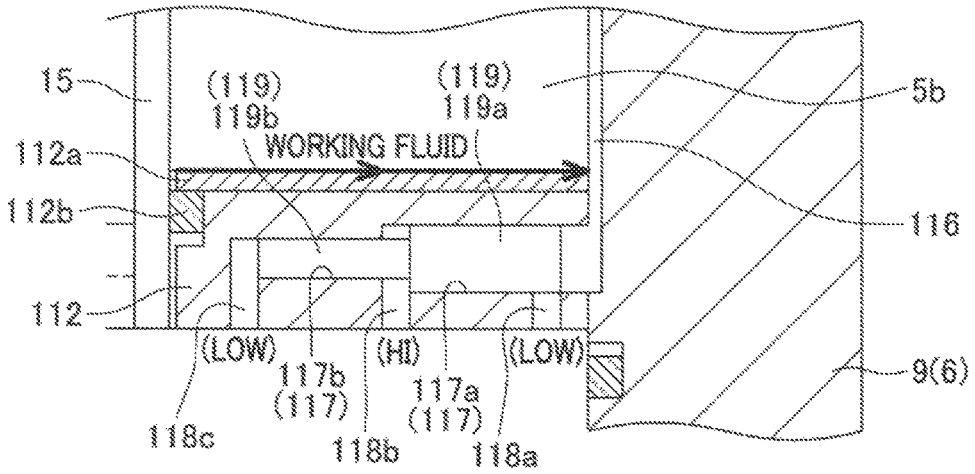
FIG. 5A and FIG. 5B each is an explanatory diagram illustrating an arrangement for pushing an end portion of an idler shaft leftward by working fluid supplied to an idler-side space.
Figure 5B:
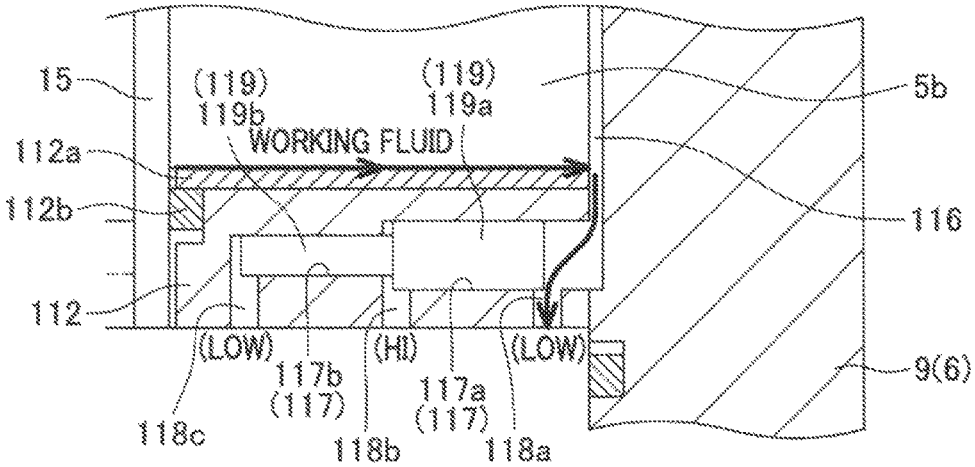

Now, a description will be given for the arrangement for pushing the end portion of the idler shaft 5*b* leftward by the working fluid supplied to the idler-side space 116, with reference to FIG. 1 and FIGS. 5A and 5B. FIGS. 5A and 5B each is a schematic explanatory diagram illustrating movement of a piston 119. In these figures, the difference between the cross sectional area of a large diameter portion 119*a* and the cross sectional area of a small diameter portion 119*b*, for example, is exaggerated.

The bearing case 112 has a cylindrical hole 117 on an outer circumference side of the idler shaft 5*b*. The cylindrical hole 117 extends along the axial direction of the idler shaft 5*b*. In FIG. 1, the cylindrical hole 117 has an opening facing the end face of the cover 9, and extends leftward from the opening. The opening of the cylindrical hole 117 communicates with the idler-side space 116. The cylindrical hole 117 has: a large diameter hole 117*a* close to the opening of the cylindrical hole 117; and a small diameter hole 117*b* disposed closer to the bottom of the cylindrical hole 117 than the large diameter hole 117*a*. The inner diameter of the small diameter hole 117*b* is slightly smaller than the inner diameter of the large diameter hole 117*a*.

The bearing case 112 has three (first to third) communication passages 118*a*, 118*b*, and 118*c* provided orthogonally to the cylindrical hole 117. The first communication passage 118*a* is provided near the opening of the cylindrical hole 117 so as to be communicable with the large diameter hole 117*a*. The second communication passage 118*b* communicates with the large diameter hole 117*a*. The third communication passage 118*c* is the closest to the bottom of the cylindrical hole 117 and communicates with the small diameter hole 117*b*.

The piston 119 is disposed inside the cylindrical hole 117 of the bearing case 112. The piston 119 has the large diameter portion 119*a* and the small diameter portion 119*b* unitary with the large diameter portion 119*a*. The piston 119 is inserted into the cylindrical hole 117 of the bearing case 112 in such a manner that: the large diameter portion 119*a* of the piston 119 is disposed in the large diameter hole 117*a* of the cylindrical hole 117; and the small diameter portion 119*b* of the piston 119 is disposed in the small diameter hole 117*b* of the cylindrical hole 117. The large diameter portion 119*a* has an outer diameter substantially equal to the inner diameter of the large diameter hole 117*a* of the cylindrical hole 117. The small diameter portion 119*b* has an outer diameter substantially equal to the inner diameter of the small diameter hole 117*b* of the cylindrical hole 117.

The first communication passage 118*a* and the third communication passage 118*c* of the bearing case 112 communicate with the low-pressure space of the figure-eight cavity 10 through unillustrated passages. The second communication passage 118*b* communicates with the high-pressure space of the figure-eight cavity 10 through an unillustrated passage.

A right end face of the large diameter portion 119*a* of the piston 119 is pushed leftward by the intermediate pressure working fluid supplied to the idler-side space 116. A left end face of the large diameter portion 119*a* (a portion of the left surface of the large diameter portion 119*a* that is not covered by the small diameter portion 119*b*) is pushed rightward by the discharge pressure working fluid supplied to the second communication passage 118*b*. The third communication passage 118*c* communicates with the low-pressure space of the figure-eight cavity 10. A left end face of the small diameter portion 119*b* is pushed by the working fluid in the third communication passage 118*c*. However, the force applied to the left end face of the small diameter portion 119*b* is negligibly small as compared with the force applied to the right end face of the large diameter portion 119*a* and the force applied to the left end face of the large diameter portion 119*a*. Consequently, the large diameter portion 119*a* of the piston 119 moves in the cylindrical hole 117, depending on which is larger, the force applied to the right end face of the large diameter portion 119*a* or the force applied to the left end face of the large diameter portion 119*a*. The magnitude of the force applied to the right end face of the large diameter portion 119*a* of the piston 119 is calculated by multiplying the pressure (P11) of the intermediate pressure working fluid supplied to the idler-side space 116 by the area (S11) of the right end face of the large diameter portion 119*a*. The magnitude of the force applied to the left end face of the large diameter portion 119*a* of the piston 119 is calculated by multiplying the pressure) of the discharge pressure working fluid supplied to the second communication passage 118*b* (the pressure P2=discharge pressure) by the area (S12) of the left end face of the large diameter portion 119*a*. The area (S12) of the left end face of the large diameter portion 119*a* is calculated by subtracting the cross sectional area of the small diameter portion 119*b* from the cross sectional area of the large diameter portion 119*a*.

FIG. 5A shows a state in which fluid communication between the idler-side space 116 and the first communication passage 118*a* is not allowed. Hereinafter, this state is referred to as a closed state because the idler-side space 116 is closed. Similarly to the case of FIG. 4A, until a sufficiently long period of time elapses from the entry into the closed state, i.e., when the pressure (P11) of the working fluid in the idler-side space 116 is not higher than a predetermined pressure value (predetermined idler-side intermediate pressure), the closed state in which fluid communication between the idler-side space 116 and the first communication passage 118*a* is not allowed is maintained because the force applied to the right end face of the large diameterportion 119*a* of the piston 119 is smaller than the force applied to the left end face of the large diameter portion 119*a* of the piston 119.

FIG. 5B shows a state in which fluid communication between the idler-side space 116 and the first communication passage 118*a* is allowed. Hereinafter, this state is referred to as an open state because the idler-side space 116 is not closed. Similarly to the case of FIG. 4B, when the pressure (P11) of the working fluid in the idler-side space 116 exceeds a predetermined pressure (predetermined idler-side intermediate pressure) as a result of inflow of the working fluid into the idler-side space 116, the force applied to the right end face of the large diameter portion 119*a* of the piston 119 becomes larger than the force applied to the left end face of the large diameter portion 119*a* of the piston 119, with the result that transition to the open state occurs, in which fluid communication between the idler-side space 116 and the first communication passage 118*a* is allowed. Thereafter, the working fluid in the idler-side space 116 flows toward the low-pressure space of the figure-eight cavity 10 through the first communication passage 118*a*, and this decreases the pressure (P11) of the working fluid in the idler-side space 116 to a level substantially equal to the low pressure. As a result, the force applied to the right end face of the large diameter portion 119*a* of the piston 119 becomes smaller than the force applied to the left end face of the large diameter portion 119*a* of the piston 119, and this causes the large diameter portion 119*a* of the piston 119 to move rightward. Thus, transition to the closed state shown in FIG. 5A occurs.

As described above, the piston 119 functions as an idler-side opening closing member configured so that: when the pressure in the idler-side space 116 is not higher than the predetermined idler-side intermediate pressure, which is lower than the discharge pressure, fluid communication between the idler-side space 116 and the first communication passage 118*a* (low-pressure space), through which the working fluid is returned to the intake pressure side (low pressure side), is not allowed; and when the pressure in the idler-side space 116 exceeds the predetermined idler-side intermediate pressure, fluid communication between the idler-side space 116 and the first communication passage 118*a* (low-pressure space) is allowed. The piston 119 includes: the left end face (closing operation pressure receiving surface) of the large diameter portion 119*a* facing the second communication passage 118*b* (high-pressure space) into which the discharge pressure working fluid is introduced; and a right end face (opening operation pressure receiving surface) of the large diameter portion 119 facing the idler-side space 116 and being larger than the closing operation pressure receiving surface. The piston 119 is disposed in the cylindrical hole 117 of the bearing case 112 disposed around the outer circumference of the idler shaft 5*b*.

During the rotation of the drive gear 2 and the driven gear 3, the thrust force produced by the meshing of the teeth, the thrust force due to liquid pressure exerted on the tooth surfaces, and the thrust force due to liquid pressure exerted on side faces of the teeth are applied to the drive gear 2 and the driven gear 3. The total sum of the thrust forces applied to the drive gear 2 (drive shaft 4*b*) is larger than the total sum of the thrust forces applied to the driven gear 3 (idler shaft 5*b*). For this reason, the gear pump 1 of the present embodiment is configured as follows: the leftward pushing pressure force applied by the working fluid in the drive-side space 16 to the drive shaft 4*b* during the rotation of the drive gear 2 and the driven gear 3 is larger than the leftward pushing pressure force applied by the working fluid in the drive-side space 16 to the idler shaft 5*b*. That is, because the pressure applied to the left end face (closing operation pressure receiving surface) of the large diameter portion 19*a*, 119*a* of the piston 19, 119, for example, is equal to the discharge pressure and is constant, the predetermined drive-side intermediate pressure and the predetermined idler-side intermediate pressure are adjustable by changing the difference in area between the left end face (closing operation pressure receiving surface) of the large diameter portion 19*a*, 119*a*, and the right end face (opening operation pressure receiving surface) of the large diameter portion 19*a*, 119*a*. In the present embodiment, the area of the right end face (opening operation pressure receiving surface) of the large diameterportion 19*a* of the piston 19 is equal to the area of the right end face (opening operation pressure receiving surface) of the large diameter portion 119*a* of the piston 119, Meanwhile, the area of the left end face (closing operation pressure receiving surface) of the large diameter portion 19*a* of the piston 19 is larger than the area of the left end face (closing operation pressure receiving surface) of the large diameter portion 119*a* of the piston 119. Accordingly, in the present embodiment, the gear pump 1 is configured, for example, as follows: when the pressure in the drive-side space 16 becomes substantially equal to approximately 50% of the discharge pressure in the closed state where fluid communication between the drive-side space 16 and the first communication passage 18*a* is not allowed, the piston 19 is moved leftward, to cause transition from the closed state to the open state where fluid communication between the drive-side space 16 and the first communication passage 18*a* is allowed; and when the pressure in the idler-side space 116 becomes substantially equal to approximately 20% of the discharge pressure in the closed state where fluid communication between the idler-side space 116 and the first communication passage 118*a* is not allowed, the piston 119 is moved leftward, to cause transition from the closed state to the open state where fluid communication between the idler-side space 116 and the first communication passage 118*a* is allowed.

<Characteristics of Gear Pump of First Embodiment>

The gear pump 1 of First Embodiment has the following characteristics.

In the gear pump 1 of the present embodiment, the drive-side space 16 facing the end portion 4*b* of the drive shaft 4 and the idler-side space 116 facing the end portion 5*b* of the idler shaft 5 are provided. The end portion 4*b* of the drive shaft 4 and the end portion 5*b* of the idler shaft 5 are respectively pushed by the pressure of the working fluid in the drive-side space 16 and the pressure of the working fluid in the idler-side space 116, and thereby the thrust forces are cancelled out. Thus, as compared with the arrangement in which friction between the end portions of the gears 2 and 3 and the side plate 15 is prevented by pistons contactable with the end portions 4*b* and 5*b*, reduction in mechanical efficiency and wearing out of parts are prevented.

In the gear pump 1 of the present embodiment, the pressure in the drive-side space 16 into which high pressure working fluid flows is adjusted so as to be not higher than the drive-side intermediate pressure lower than the high pressure, and the pressure in the idler-side space 116 into which high pressure working fluid flows is adjusted so as to be not higher than the idler-side intermediate pressure lower than the high pressure. This prevents application of too large pushing forces to the end portion 4*b* of the drive shaft 4 and the end portion 5*b* of the idler shaft 5, respectively based on the pressure of the working fluid in the drive-side space 16 and the pressure of the working fluid in the idler-side space 116.

In the gear pump 1 of the present embodiment, by changing the difference in area between the closing operation pressure receiving surface and the opening operation pressure receiving surface of the piston 19, 119, the ratio of the drive-side intermediate pressure to the discharge pressure and the ratio of the idler-side intermediate pressure to the discharge pressure are changeable, and thus, the levels of the drive-side intermediate pressure and the idler-side intermediate pressure are adjustable.

In the gear pump 1 of the present embodiment, the total length of the gear pump 1 is shortened as compared with a gear pump like a gear pump 201 of Second Embodiment, in which pistons 219 and 319 are disposed to be opposed to the drive shaft 4 and the idler shaft 5, respectively.

(Second Embodiment)

The following describes a gear pump 201 of Second Embodiment of the present invention. Main differences between the gear pump 201 of Second Embodiment and the gear pump 1 of First Embodiment are structure and location of pistons configured to respectively open and close the drive-side space and the idler-side space. The other components of the gear pump 201 of Second Embodiment are similar to those of the gear pump 1 of First Embodiment, and therefore, the same reference sings are given to the same components and the descriptions thereof are not repeated.

Figure 6:
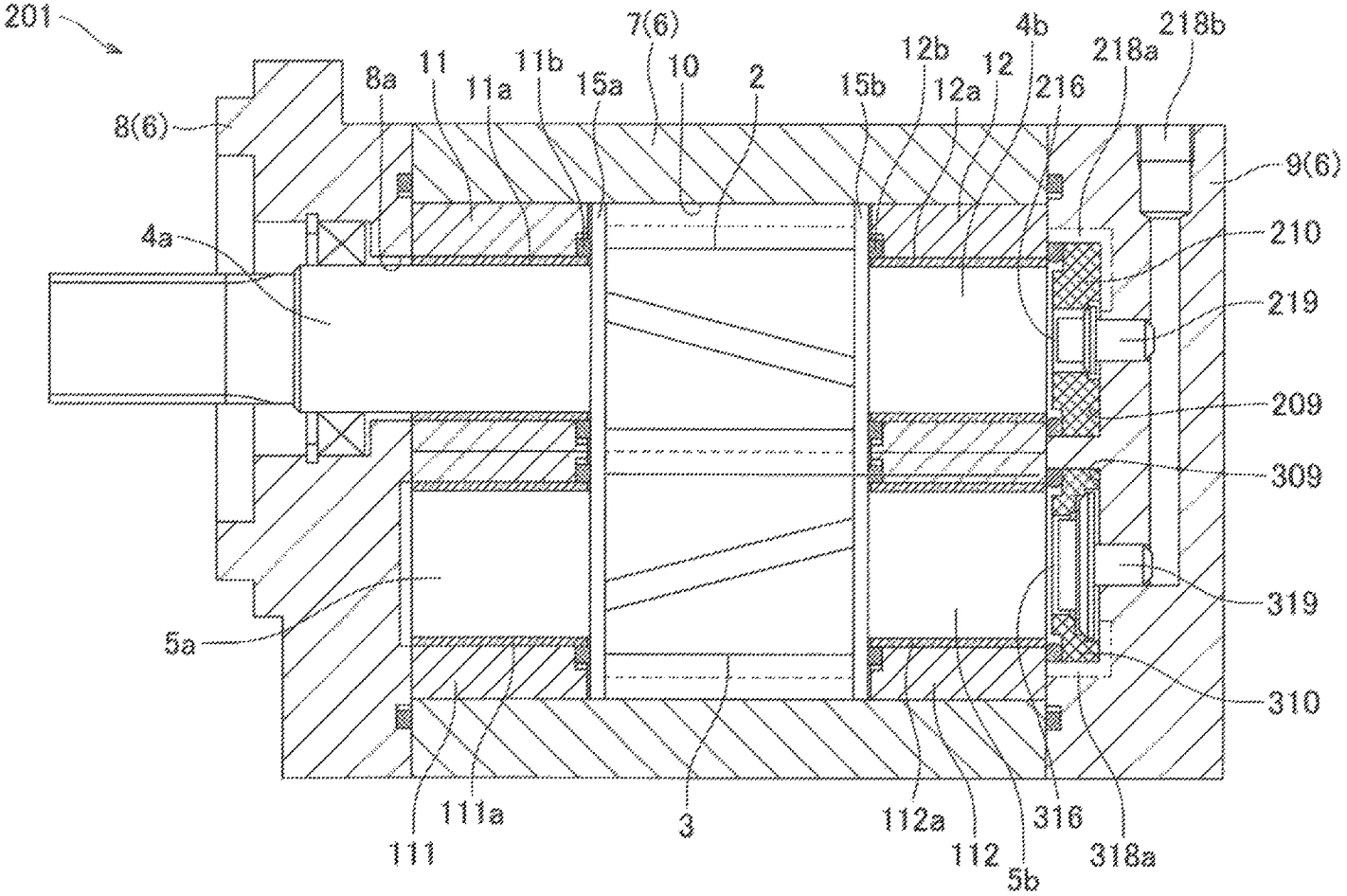
FIG. 6 is an explanatory diagram illustrating the overall structure of a gear pump of Second Embodiment of the present invention.

As shown in FIG. 6, in the casing 6 of the gear pump 201 of the present embodiment, a drive-side space 216 and an idler-side space 316 are provided. The drive-side space 216 faces an end portion (right end portion in FIG. 6) of the drive shaft 4*b*. The idler-side space 316 faces an end portion (right end portion in FIG. 6) of the idler shaft 5*b*. The drive-side space 216 and the idler-side space 316 are configured so that: working fluid at the discharge pressure (high pressure) is supplied to these spaces from the figure-eight cavity 10; and the pressure in each of the spaces 216 and 316 can be kept so as not to exceed a corresponding predetermined intermediate pressure, which is higher than a low pressure (pressure in the low-pressure space) and lower than the discharge pressure. Due to this, during the rotation of the drive gear 2 and the driven gear 3, the end portion of the drive shaft 4*b* is pushed leftward by the working fluid supplied to the drive-side space 216 in FIG. 6, and the end portion of the idler shaft 5*b* is pushed leftward by the working fluid supplied to the idler-side space 316 in FIG. 6. During the rotation of the drive gear 2 and the driven gear 3, a thrust force produced by the meshing of the teeth, a thrust force due to liquid pressure exerted on the tooth surfaces, and a thrust force due to liquid pressure exerted on side faces of the teeth are applied to the drive gear 2 and the driven gear 3. As a result, end portions of the gears 2 and 3 are pushed rightward. However, these thrust forces are cancelled out by the pushing force of the working fluid in the drive-side space 216 and the pushing force of the working fluid in the idler-side space 316.

First of all, a description will be given for the arrangement for pushing the end portion of the drive shaft 4*b* leftward by the working fluid supplied to the drive-side space 216, with reference to FIG. 6 and FIGS. 7A and 7B.

In the cover 9, a first communication passage 218*a* and a second communication passage 218*b* are provided. The first communication passage 218*a* communicates with the low-pressure space of the figure-eight cavity 10 through an unillustrated passage. The second communication passage 218*b* communicates with the high-pressure space of the figure-eight cavity 10 through another unillustrated passage. The second communication passage 218*b* includes portions respectively located to the right of the drive shaft 4*b* and the idler shaft 5*b* in FIG. 6.

A recess 209 facing the drive shaft 4*b* is provided on an end face of the cover 9. A cylindrical outer circumferential member 210 is fitted in the recess 209. The outer circumferential member 210 has a large diameterhole 217*a* which is a through hole. The recess 209 communicates with the second communication passage 218*b* via a small diameter hole 217*b*, which is a through hole extending along the axial direction of the drive shaft 4*b* and opening onto a bottom surface of the recess 209. The large diameter hole 217*a* and the small diameter hole 217*b* are disposed coaxially, and form a cylindrical hole 217. Thus, the cylindrical hole 217 includes: the large diameter hole 217*a* disposed close to the drive shaft 4*b*; and the small diameter hole 217*b* disposed closer to the second communication passage 218*b* than the large diameter hole 217*a*. The inner diameter of the small diameter hole 217*b* is smaller than the inner diameter of the large diameter hole 217*a*.

A piston 219 is disposed in the cylindrical hole 217. The piston 219 has a large diameter portion 219*a* and a small diameter portion 219*b* unitary with the large diameter portion 219*a*. The large diameter portion 219*a* of the piston 219 is disposed in the large diameter hole 217*a* of the cylindrical hole 217. The small diameter portion 219*b* of the piston 219 is disposed in the small diameter hole 217*b* of the cylindrical hole 217. The large diameter portion 219*a* has an outer diameter larger than the inner diameter of the large diameter hole 217*a* of the cylindrical hole 217. The small diameter portion 219*b* has an outer diameter substantially equal to the inner diameter of the small diameter hole 217*b* of the cylindrical hole 217.

The outer circumferential member 210 has a step portion 211 facing the bottom surface of the recess 209 of the cover 9. The step portion 211 is along the entire inner circumference of the outer circumferential member 210. The large diameter portion 219*a* of the piston 219 disposed inside the large diameter hole 217*a* has a conical seal portion 212 opposed to the step portion 211. The piston 219 is switchable between a closed state in which the seal portion 212 of the piston 219 is in contact with (is pressed onto) the step portion 211, and an open state in which the seal portion 212 of the piston 219 is separated from the step portion 211.

The first communication passage 218*a* in the cover 9 communicatively opens to the bottom surface of the recess 209 of the cover 9. Thus, when the piston 219 is in the closed state, fluid communication is not allowed between the drive-side space 216 and the first communication passage 218*a* through which working fluid is returned to the low-pressure space of the figure-eight cavity 10. Meanwhile, when the piston 219 is in the open state, fluid communication is allowed between the drive-side space 216 and the first communication passage 218*a* through which working fluid is returned to the low-pressure space of the figure-eight cavity 10.

The left end face of the large diameter portion 219*a* of the piston 219 (including a portion of the left end face of the large diameter portion 219*a* where an extension portion 219*c* is provided) is pushed rightward by the intermediate pressure working fluid supplied to the drive-side space 216. The right end face of the small diameter portion 219*b* of the piston 219 is pushed leftward by the discharge pressure working fluid supplied to the second communication passage 218*b*. Consequently, the piston 219 moves in the cylindrical hole 217, depending on which is larger, the force applied to the left end face of the large diameter portion 219*a* or the force applied to the right end face of the small diameter portion 219*b*. The magnitude of the force applied to the left end face of the large diameter portion 219*a* of the piston 219 is calculated by multiplying the pressure (P101) of the intermediate pressure working fluid supplied to the drive-side space 216 by the area (S101) of the left end face of the large diameter portion 219*a*. The magnitude of the force applied to the right end face of the small diameter portion 219*b* of the piston 219 is calculated by multiplying the pressure (P2) of the discharge pressure working fluid supplied to the second communication passage 218*b* (the pressure P2=discharge pressure) by the area (S102) of the right end face of the small diameter portion 219*b*. Here, the area (S101) of the left end face of the large diameter portion 219*a* is, specifically, the area of a portion of the left end face of the large diameter portion 219*a* that is located inside relative to an innermost circumferential edge of the step portion of the outer circumferential member.

Figure 7A:
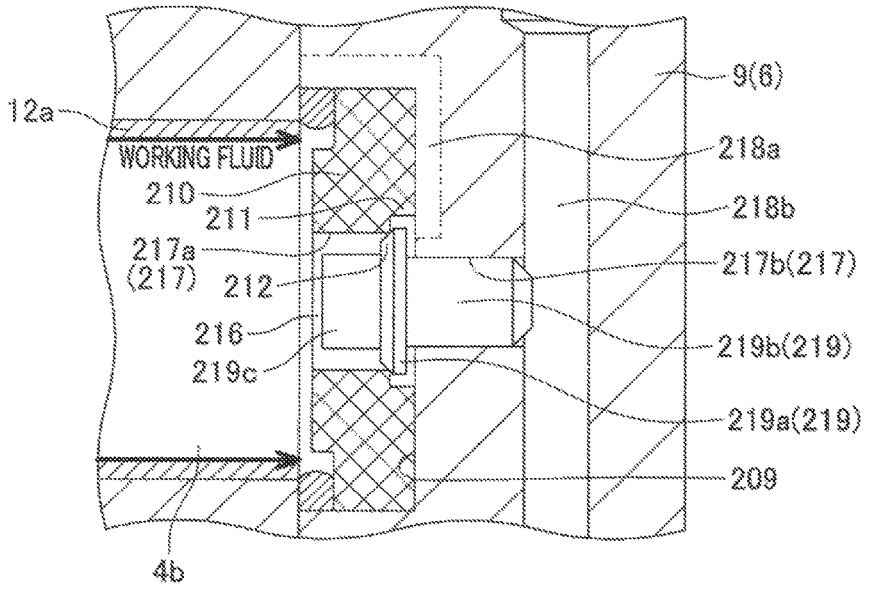
FIG. 7A and FIG. 7B each is an explanatory diagram illustrating an arrangement for pushing an end portion of a drive shaft leftward by working fluid supplied to a drive-side space.

FIG. 7A shows a state in which fluid communication between the drive-side space 216 and the first communication passage 218*a* is not allowed. Hereinafter, this state is referred to as the closed state because the drive-side space 216 is closed, in the closed state, a left peripheral surface of the large diameter portion 219*a* of the piston 219 is in contact with the step portion 211 of the outer circumferential member 210. When the drive gear 2 and the driven gear 3 are rotated, the working fluid in the high-pressure space of the figure-eight cavity 10 passes through a gap between the drive shaft 4*b* and the bearing 12*a* into the drive-side space 216. This increases the pressure (P101) of the working fluid in the drive-side space 216 toward the pressure level equal to that in the high-pressure space of the figure-eight cavity 10. As a result, the force applied to the left end face of the large diameter portion 219*a* of the piston 219 increases. The magnitude of the force applied to the right end face of the small diameter portion 219*b* of the piston 219 is calculated by multiplying the pressure (P2) of the discharge pressure working fluid in the second communication passage 218*b* (the pressure P2=discharge pressure) by the area (S102) of the tight end face of the small diameter portion 219*b*. That is, the force applied to the right end face of the small diameter portion 219*b* is always constant. Accordingly, until a sufficiently long period of time elapses from the entry into the closed state, i.e., when the pressure (P101) of the working fluid in the drive-side space 216 is not higher than a predetermined pressure value (predetermined drive-side intermediate pressure), the closed state in which fluid communication between the drive-side space 216 and the second communication passage 218*b* is not allowed is maintained because the force applied to the left end face of the large diameter portion 219*a* of the piston 219 is smaller than the force applied to the tight end face of the small diameter portion 219*b* of the piston 219.

Figure 7B:
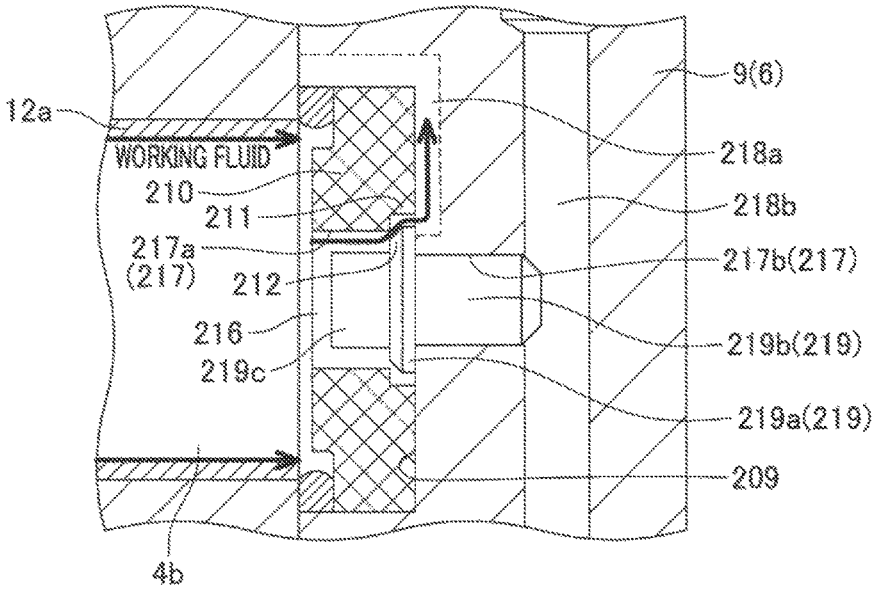

FIG. 7B shows a state in which fluid communication between the drive-side space 216 and the first communication passage 218*a* is allowed. Hereinafter, this state is referred to as the open state because the drive-side space 216 is not closed. In the open state, the large diameter portion 219*a* of the piston 219 has been moved rightward in the cylindrical hole 217, and thereby the left peripheral surface of the large diameter portion 219*a* of the piston 219 is separated from the step portion 211 of the outer circumferential member 210. Transition to the open state, in which fluid communication between the drive-side space 216 and the first communication passage 218*a* is allowed, occurs in the following manner. During the rotation of the drive gear 2 and the driven gear 3, the working fluid in the high-pressure space of the figure-eight cavity 10 passes through the gap between the drive shaft 4*b* and the bearing 12*a* into the drive-side space 216. Then, the pressure (P101) of the working fluid in the drive-side space 216 increases, with the result that the force applied to the left end face of the large diameter portion 219*a* of the piston 219 becomes larger than the force applied to the right end face of the small diameter portion 219*b* of the piston 219. As a consequence, the large diameter portion 219*a* of the piston 219 moves rightward, and thus the transition to the open state occurs. Thereafter, the working fluid in the drive-side space 216 flows toward the low-pressure space of the figure-eight cavity 10 through the first communication passage 218*a*, and this decreases the pressure (P101) of the working fluid in the drive-side space 216 to a level substantially equal to the low pressure. As a result, the force applied to the left end face of the large diameter portion 219*a* of the piston 219 becomes smaller than the force applied to the right end face of the small diameter portion 219*b* of the piston 219, and this causes the large diameter portion 219*a* of the piston 219 to move leftward. Thus, transition to the closed state shown in FIG. 7A occurs.

As described above, the piston 219 functions as a drive-side opening closing member configured so that: when the pressure in the drive-side space 216 is not higher than the predetermined drive-side intermediate pressure, which is lower than the discharge pressure, fluid communication between the drive-side space 216 and the first communication passage 218*a* (low-pressure space), through which the working fluid is returned to the intake pressure side (low pressure side), is not allowed; and when the pressure in the drive-side space 216 exceeds the predetermined drive-side intermediate pressure, fluid communication between the drive-side space 216 and the first communication passage 218*a* (low-pressure space) is allowed. The piston 219 includes: the right end face (closing operation pressure receiving surface) of the small diameter portion 219*b* facing the second communication passage 218*b* (high-pressure space) into which the discharge pressure (high pressure) working fluid is introduced; and the left end face (opening operation pressure receiving surface) of the large diameter portion 219*a* facing the drive-side space 216 and being larger than the closing operation pressure receiving surface.

Now, a description will be given for the arrangement for pushing the end portion of the idler shaft 5*b* leftward by the working fluid supplied to the idler-side space 316, with reference to FIG, 6 and FIGS. 8A and 8B.

In the cover 9, a first communication passage 318*a* and the second communication passage 218*b* are provided. The third communication passage 318*a* communicates with the low-pressure space of the figure-eight cavity 10 through an unillustrated passage. The second communication passage 218*b* communicates with the high-pressure space of the figure-eight cavity 10 through another unillustrated passage.

A recess 309 facing the idler shaft 5*b* is provided on the end face of the cover 9. A cylindrical outer circumferential member 310 is fitted in the recess 309. The outer circumferential member 310 has a large diameter hole 317*a* which is a through hole. The recess 309 communicates with the second communication passage 218*b* via a small diameter hole 317*b*, is a through hole extending along the axial direction of the idler shaft 5*b* and opening onto bottom surface of the recess 309. The large diameter hole 317*a* and the small diameter hole 317*b* are disposed coaxially, and form a cylindrical hole 317. Thus, the cylindrical hole 317 includes: the large diameter hole 317*a* disposed close to the idler shaft 5*b*; and the small diameter hole 317*b* disposed closer to the second communication passage 218*b* than the large diameter hole 317*a*. The inner diameter of the small diameter hole 317*b* is smaller than the inner diameter of the large diameter hole 317*a*.

A piston 319 is disposed in the cylindrical hole 317. The piston 319 has a large diameter portion 319*a* and a small diameter portion 319*b* unitary with the large diameter portion 319*a*. The large diameter portion 319*a* of the piston 319 is disposed in the large diameter hole 317*a* of the cylindrical hole 317. The small diameter portion 319*b* of the piston 319 is disposed in the small diameter hole 317*b* of the cylindrical hole 317. The large diameterportion 319*a* has an outer diameter larger than the inner diameter of the large diameter hole 317*a* of the cylindrical hole 317. The small diameter portion 319*b* has an outer diameter substantially equal to the inner diameter of the small diameter hole 317*b* of the cylindrical hole 317.

The outer circumferential member 310 has a step portion 311 facing the bottom surface of the recess 309 of the cover 9. The step portion 311 is along the entire inner circumference of the outer circumferential member 310. The large diameter portion 319*a* of the piston 319 disposed inside the large diameter hole 317*a* has a conical seal portion 312 aligned with the step portion 311. The piston 319 is switchable between a closed state in which the seal portion 312 of the piston 319 is in contact with (is pressed onto) the step portion 311, and an open state in which the seal portion 312 of the piston 319 is separated from the step portion 311.

The first communication passage 318*a* in the cover 9 communicatively opens to the bottom surface of the recess 309 of the cover 9. Thus, when the piston 319 is in the closed state, fluid communication is not allowed between the idler-side space 316 and the first communication passage 318*a* through which working fluid is returned to the low-pressure space of the figure-eight cavity 10. Meanwhile, when the piston 319 is in the open state, fluid communication is allowed between the idler-side space 316 and the first communication passage 318*a* through which working fluid is returned to the low-pressure space of the figure-eight cavity 10.

The left end face of the large diameter portion 319*a* of the piston 319 (including a portion of the left end face of the large diameter portion 319*a* where an extension portion 319*c* is provided) is pushed rightward by the intermediate pressure working fluid supplied to the idler-side space 316. The right end face of the small diameter portion 319*b* of the piston 319 is pushed leftward by the discharge pressure working fluid in the second communication passage 218*b*. Consequently, the piston 319 moves in the cylindrical hole 317, depending on which is larger, the force applied to the left end face of the large diameter portion 319*a* or the force applied to the right end face of the small diameter portion 319*b*. The magnitude of the force applied to the left end face of the large diameter portion 319*a* of the piston 319 is calculated by multiplying the pressure (P111) of the intermediate pressure working fluid supplied to the idler-side space 316 by the area (S111) of the left end face of the large diameter portion 319*a*. The magnitude of the force applied to the right end face of the small diameter portion 319*b* of the piston 319 is calculated by multiplying the pressure (P2) of the discharge pressure working fluid supplied to the second communication passage 218*b* (the pressure P2=discharge pressure) by the area (S112) of the right end face of the small diameter portion 319*b*. Here, the area (S111) of the left end face of the large diameter portion 319*a* is, specifically, the area of a portion of the left end face of the large diameter portion 319*a* that is located inside relative to an innermost circumferential edge of the step portion of the outer circumferential member.

Figure 8A:
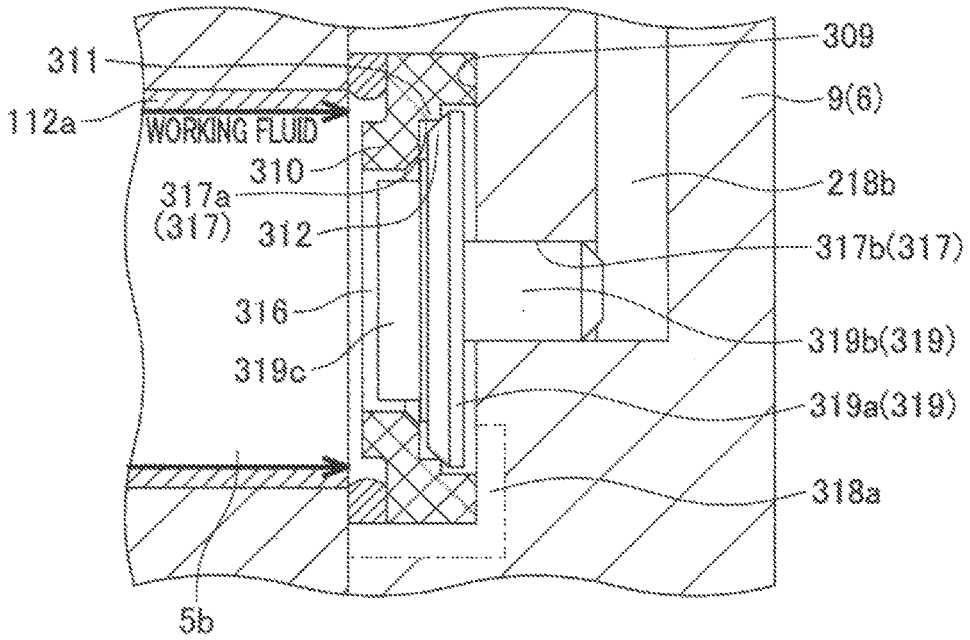
FIG. 8A and FIG. 8B each is an explanatory diagram illustrating an arrangement for pushing an end portion of an idler shaft leftward by working fluid supplied to an idler-side space.

FIG. 8A shows a state in which fluid communication between the idler-side space 316 and the first communication passage 318*a* is not allowed. Hereinafter, this state is referred to as the closed state because the idler-side space 316 is closed. Similarly to the case of FIG. 7A, until a sufficiently long period of time elapses from the entry into the dosed state, i.e., when the pressure (P111) of the working fluid in the idler-side space 316 is not higher than a predetermined pressure value (predetermined idler-side intermediate pressure), the closed state in which fluid communication between the idler-side space 316 and the first communication passage 318*a* is not allowed is maintained because the force applied to the left end face of the large diameter portion 319*a* of the piston 319 is smaller than the force applied to the right end face of the small diameter portion 319*b* of the piston 319.

Figure 8B:
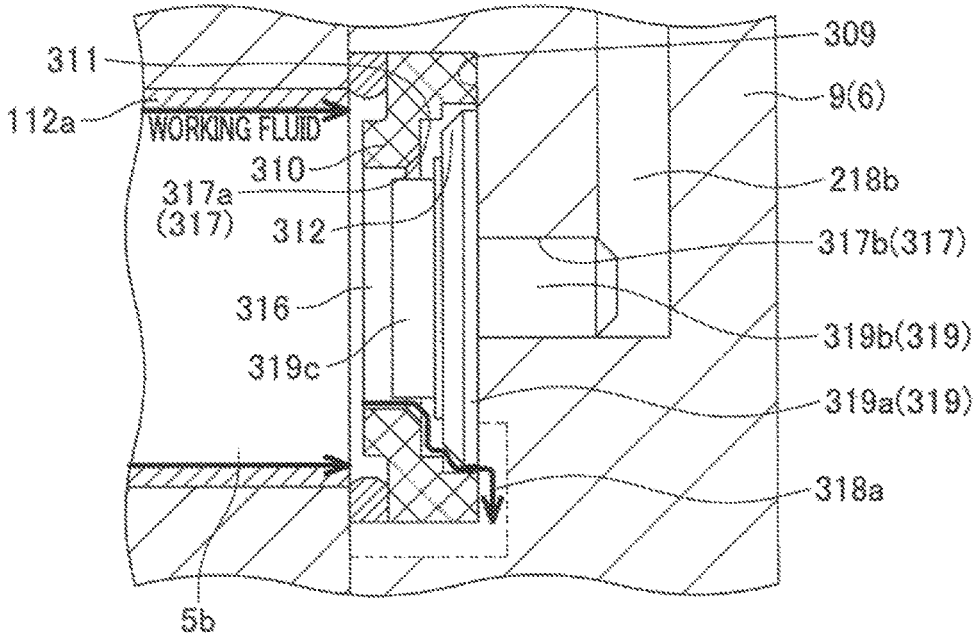

FIG. 8B shows a state in which fluid communication between the idler-side space 316 and the first communication passage 318*a* is allowed. Hereinafter, this state is referred to as the open state because the idler-side space 316 is not closed. Similarly to the case of FIG. 7B, when the pressure (P111) of the working fluid in the idler-side space 316 exceeds the predetermined pressure (predetermined idler-side intermediate pressure) as a result of inflow of the working fluid into the idler-side space 316, the force applied to the left end face of the large diameter portion 319*a* of the piston 319 becomes larger than the force applied to the right end face of the small diameter portion 319*b* of the piston 319. This moves the large diameter portion 319*a* of the piston 319 rightward, with the result that transition to the open state occurs, in which fluid communication between the idler-side space 316 and the first communication passage 318*a* is allowed. Thereafter, the working fluid in the idler-side space 316 flows toward the low-pressure space of the figure-eight cavity 10 through the first communication passage 318*a*, and this decreases the pressure (P111) of the working fluid in the idler-side space 316 to a level substantially equal to the low pressure. As a result, the force applied to the left end face of the large diameter portion 319*a* of the piston 319 becomes smaller than the force applied to the right end face of the small diameter portion 319*b* of the piston 319, and this causes the large diameter portion 319*a* of the piston 319 to move leftward. Thus, transition to the closed state shown in FIG. 8A occurs.

As described above, the piston 319 functions as an idler-side opening closing member configured so that: when the pressure in the idler-side space 316 is not higher than the predetermined idler-side intermediate pressure, which is lower than the discharge pressure, fluid communication between the idler-side space 316 and the first communication passage 318*a* (low-pressure space), through which the working fluid is returned to the intake pressure side (low pressure side), is not allowed; and when the pressure in the idler-side space 316 exceeds the predetermined idler-side intermediate pressure, fluid communication between the idler-side space 316 and the first communication passage 318*a* (low-pressure space) is allowed. The piston 319 includes: the right end face (closing operation pressure receiving surface) of the small diameter portion 319*b* facing the second communication passage 218*b* (high-pressure space) into which the discharge pressure (high pressure) working fluid is introduced; and the left end face (opening operation pressure receiving surface) of the large diameter portion 319*a* facing the idler-side space 316 and being larger than the closing operation pressure receiving surface.

In the present embodiment, similarly to First Embodiment, the predetermined drive-side intermediate pressure and the predetermined idler-side intermediate pressure are adjustable by changing the difference in area between the right end face (closing operation pressure receiving surface) of the small diameter portion 219*b*, 319*b*, and the left end face (opening operation pressure receiving surface) of the large diameter portion 219*a*, 319*a* of the piston 219, 319.

<Characteristics of Gear Pump of Second Embodiment>

The gear pump 201 of Second Embodiment has the following characteristics.

In the gear pump 201 of Second Embodiment, similarly to the gear pump 1 of First Embodiment, the drive-side space 216 facing the end portion 4*b* of the drive shaft 4 and the idler-side space 316 facing the end portion 5*b* of the idler shaft 5 are provided. The end portion 4*b* of the drive shaft 4 and the end portion 5*b* of the idler shaft 5 are respectively pushed by the pressure of the working fluid in the drive-side space 216 and the pressure of the working fluid in the idler-side space 316, and thereby the thrust forces are cancelled out. Thus, as compared with the arrangement in which the end portions 4*b* and 5*b* are pushed by pistons contactable with the end portions 4*b* and 5*b*, reduction in mechanical efficiency and wearing out of parts are prevented. Other than the above, advantageous effects similar to those of the gear pump 1 of First Embodiment are provided.

Thus, the embodiments of the present invention have been described hereinabove. However, the specific structure of the present invention shall not be interpreted as to be limited to the above described embodiments. The scope of the present invention is defined not by the above embodiments but by claims set forth below, and shall encompass the equivalents in the meaning of the claims and every modification within the scope of the claims.

The above-described embodiments each deals with the case where each piston has: the closing operation pressure receiving surface facing the high-pressure space into which the discharge pressure working fluid is introduced; and the opening operation pressure receiving surface facing the drive-side space or the idler-side space and larger than the closing operation pressure receiving surface. However, the structure of the piston may be changed.

The above-described embodiments each deals with the case where hydraulic oil is used as the working fluid. However, fluid other than oil (e.g., water) may be used as the working fluid.

The above-described embodiments each deals with the case where the present invention is applied to a gear pump. However, the present invention is applicable to a gear motor configured similarly to the gear pump.

INDUSTRIAL APPLICABILITY

With the use of the present invention, reduction in mechanical efficiency and wearing out of parts are prevented.

What is claimed is:

1. A gear pump or a gear motor comprising:

a casing;

a helical drive gear and a helical driven gear, the drive gear and the driven gear meshing with each other in the casing and partitioning an inside of the casing so as to include a high-pressure space and a low-pressure space;

a drive-side space and an idler-side space each configured to allow pressure therein to become higher than a pressure in the low-pressure space, the drive-side space facing an end portion of a drive shaft rotatably supporting the drive gear, the idler-side space facing an end portion of an idler shaft rotatably supporting the driven gear;

a drive-side opening closing member configured to take a first position or a second position different from the first position, the drive-side opening closing member being further configured so that when the pressure in the drive-side space is not higher than a drive-side intermediate pressure lower than a pressure in the high-pressure space, the drive-side opening closing member is in the first position and fluid communication between the drive-side space and the low-pressure space is not allowed, and when the pressure in the drive-side space exceeds the drive-side intermediate pressure, the drive-side opening closing member is in the second position and fluid communication between the drive-side space and the low-pressure space is allowed; and an idler-side opening closing member configured to take a third position or a fourth position different from the third position. the idler-side opening closing member being further configured so that when the pressure in the idler-side space is not higher than an idler-side intermediate pressure lower than the pressure in the high-pressure space, the idler-side opening closing member is in the third position and fluid communication between the idler-side space and the low-pressure space is not allowed, and when the pressure in the idler-side space exceeds the idler-side intermediate pressure, the idler-side opening closing member is in the fourth position and fluid communication between the idler-side space and the low-pressure space is allowed, the end portion of the drive shaft being pushed in a predetermined direction by working fluid supplied to the drive-side space, and the end portion of the idler shaft being pushed in the predetermined direction by working fluid supplied to the idler-side space.

2. The gear pump or gear motor according to claim 1, wherein each of the drive-side opening closing member and the idler-side opening closing member includes a closing operation pressure receiving surface facing the high-pressure space into which working fluid at a high pressure is introduced, an opening operation pressure receiving surface facing the drive-side space or the idler-side space and being larger than the closing operation pressure receiving surface.

3. The gear pump or gear motor according to claim 2, further comprising a drive-side bearing member provided around an outer circumference of the drive shaft; and an idler-side bearing member provided around an outer circumference of the idler shaft, the drive-side opening closing member being provided in the drive-side bearing member, and the idler-side opening closing member being provided in the idler-side bearing member.

4. The gear pump or gear motor according to claim 1, further comprising a drive-side bearing member provided around an outer circumference of the drive shaft; and an idler-side bearing member provided around an outer circumference of the idler shaft, the drive-side opening closing member being provided in the drive-side bearing member, and the idler-side opening closing member being provided in the idler-side bearing member.

* * * * *